US009452919B2

(12) United States Patent
Dal Toso

(10) Patent No.: US 9,452,919 B2
(45) Date of Patent: Sep. 27, 2016

(54) POURING DEVICE FOR BOTTLES AND ORIENTING APPARATUS FOR CAPPING PLANTS

(75) Inventor: Nicola Dal Toso, Ponte di Barbarano (IT)

(73) Assignee: ANTICHE DISTILLERIE RIUNITE S.R.L., Ponte di Barbarano (VI) (IT)

( * ) Notice: Subject to any disclaimer, the term of this patent is extended or adjusted under 35 U.S.C. 154(b) by 737 days.

(21) Appl. No.: 13/697,727

(22) PCT Filed: May 26, 2011

(86) PCT No.: PCT/IB2011/052294

§ 371 (c)(1),
(2), (4) Date: Nov. 13, 2012

(87) PCT Pub. No.: WO2011/148334

PCT Pub. Date: Dec. 1, 2011

(65) Prior Publication Data

US 2013/0074448 A1 Mar. 28, 2013

(30) Foreign Application Priority Data

May 26, 2010 (IT) ..... VI2010A0149

(51) Int. Cl.
*B65D 25/44* (2006.01)
*B67B 3/26* (2006.01)
(Continued)

(52) U.S. Cl.
CPC ..... *B67B 3/262* (2013.01); *B65D 23/14* (2013.01); *B65D 47/06* (2013.01); *B65D 47/061* (2013.01);
(Continued)

(58) Field of Classification Search
CPC ..... B65D 25/44; B65D 47/26; B65D 47/06; B65D 47/061; B65D 25/40; B65D 25/42; B65D 25/48; B65D 47/00; B65D 47/04; B65D 47/127; B65D 47/32; B67B 3/26
USPC ..... 222/525, 522, 519, 520; 53/367
See application file for complete search history.

(56) References Cited

U.S. PATENT DOCUMENTS 1,748,680 A * 2/1930 Schrader ..... B65D 25/44 222/129
2,041,784 A * 5/1936 Shore ..... B65D 47/061 222/498

(Continued)

FOREIGN PATENT DOCUMENTS

| | | |
|---|---|---|
| EP | 1867573 | 12/2007 |
| GB | 161276 | 4/1921 |
| GB | 667081 | 2/1952 |

OTHER PUBLICATIONS

Compressed-Gas Cylinder-Outlet-Connections-Table 1. (The CGA standard was established on 1913). Ted Pella, INC; www.tedpella.com.*

*Primary Examiner* — Sameh Tawfik
*Assistant Examiner* — Eduardo R Ferrero
(74) *Attorney, Agent, or Firm* — Themis Law

(57) ABSTRACT

A liquid pouring device for bottles includes a tubular body defining a longitudinal axis and having an axial cavity open at the ends for the passage and pouring of the liquid contained in the bottle, an anchorage element of the tubular body to the neck of a bottle, a pouring spout slidably inserted in the cavity in order to be moved between an inoperative position completely contained in the cavity and an operative position in which it has at least one longitudinal end portion projecting outwardly of the cavity for allowing the controlled pouring of the liquid. The longitudinal end portion in operative position is inclined by a predetermined inclination angle with respect to the longitudinal axis in order to define a selective orientation for the spout during the pouring of the liquid. An orienting apparatus for capping plants is also described.

9 Claims, 6 Drawing Sheets

(51) Int. Cl.

| | |
|---|---|
| ***B65D 23/14*** | (2006.01) |
| ***B65D 47/06*** | (2006.01) |
| ***B65D 47/32*** | (2006.01) |
| ***B67B 3/20*** | (2006.01) |
| *B65D 25/42* | (2006.01) |
| *B65D 47/00* | (2006.01) |
| *B65D 25/48* | (2006.01) |
| *B65D 25/40* | (2006.01) |
| *B65D 47/04* | (2006.01) |

(52) U.S. Cl.
CPC ..... *B65D 47/32* (2013.01); *B67B 3/20* (2013.01); *B65D 25/40* (2013.01); *B65D 25/42* (2013.01); *B65D 25/44* (2013.01); *B65D 25/48* (2013.01); *B65D 47/00* (2013.01); *B65D 47/04* (2013.01); *B65D 2303/00* (2013.01)

(56) References Cited

U.S. PATENT DOCUMENTS 2,093,807 A * 9/1937 Emery ..... B65D 47/061 222/484
2,204,176 A * 6/1940 Chamberlain ..... B65D 25/44 222/535
2,623,664 A * 12/1952 Henchert ..... B65D 47/061 222/525
2,695,736 A * 11/1954 Punte ..... B65D 47/061 222/489
2,736,469 A * 2/1956 Stone ..... B65D 47/061 222/529
2,761,597 A * 9/1956 Stukey ..... B65D 47/061 222/525
2,810,499 A * 10/1957 Forman ..... B65D 47/248 222/482
2,840,281 A * 6/1958 Ostermann ..... B65D 47/061 222/484
2,968,423 A * 1/1961 Mahler ..... G01F 11/265 222/482
3,058,631 A * 10/1962 De La Hitte ..... B65D 47/244 222/507
3,078,014 A * 2/1963 Livingstone ..... B65D 25/44 222/110
3,217,950 A * 11/1965 Goodson ..... B65D 47/06 222/484
3,343,731 A * 9/1967 Wonso ..... B65D 47/061 222/519
3,369,710 A * 2/1968 Lucas ..... B65D 47/061 222/109
3,434,637 A * 3/1969 Marcel ..... B65D 47/127 222/570
3,856,188 A * 12/1974 Newby ..... B65D 25/44 222/478
3,915,360 A * 10/1975 Leger ..... B65D 17/165 222/538
3,929,264 A * 12/1975 Maynard, Jr. ..... B65D 47/122 222/525
3,938,714 A * 2/1976 Coppersmith ..... B65D 17/165 222/525
4,610,374 A * 9/1986 Buehler ..... A61J 1/2089 141/329
4,650,096 A * 3/1987 Thatcher ..... B65D 47/061 222/153.06
4,653,676 A * 3/1987 Stull ..... B65D 47/06 215/321
4,807,785 A * 2/1989 Pritchett ..... G01F 11/28 222/442
4,979,655 A * 12/1990 Gallucci ..... B65D 47/263 141/332
5,141,129 A * 8/1992 Jennings ..... B65D 50/061 206/536
5,197,634 A * 3/1993 Beck ..... B65D 47/246 222/109
5,799,839 A * 9/1998 Moran ..... B65D 47/243 222/484
5,839,611 A * 11/1998 Obadia ..... B65D 41/3452 222/153.14
6,026,994 A * 2/2000 Rigel ..... B65D 47/061 222/478
6,230,944 B1 * 5/2001 Castellano ..... B65D 47/243 222/481.5
6,257,463 B1 * 7/2001 De Polo ..... B65D 47/243 222/525
6,659,308 B1 * 12/2003 Kelder ..... B65D 51/226 222/494
7,237,692 B2 * 7/2007 Bodum ..... B65D 47/265 222/109
7,651,003 B2 * 1/2010 Albers ..... B65D 47/263 215/251
7,703,642 B2 * 4/2010 Scott ..... B65D 47/127 215/254
7,721,916 B2 * 5/2010 Szekely ..... B65D 47/123 222/109
8,083,055 B2 * 12/2011 Simonian et al. ... B65D 47/243 206/221
2004/0026464 A1 * 2/2004 Granger ..... B65D 47/061 222/545
2005/0006418 A1 * 1/2005 Rigel ..... B65D 47/061 222/481.5
2006/0273119 A1 * 12/2006 Lee ..... B65D 47/061 222/525
2007/0205229 A1 * 9/2007 Schmeisser ..... B65D 47/061 222/525
2009/0045224 A1 * 2/2009 Faaborg ..... B65D 41/0471 222/111
2010/0043910 A1 * 2/2010 Szekely ..... B65D 47/06 141/1
2011/0084090 A1 * 4/2011 MacDougall ..... B65D 25/44 222/1
2011/0266251 A1 * 11/2011 Rigel ..... B65D 51/18 215/386
2013/0068799 A1 * 3/2013 Rigel ..... B65D 41/0414 222/481
2013/0074448 A1 * 3/2013 Dal Toso ..... B65D 23/14 53/367

* cited by examiner

POURING DEVICE FOR BOTTLES AND ORIENTING APPARATUS FOR CAPPING PLANTS

FIELD OF APPLICATION

The present invention can be applied to the filed of containers for liquids, and in particular has as object a retractable pouring device for bottles.

The invention also has as object an orienting apparatus for bottle capping plants in which a bottle is assembled with the device according to the invention.

BACKGROUND ART

As is known, the use of pourers applied to bottles of any shape and type is widely diffused, since with such pourers it is possible to pour the liquid contained in the same in a precise manner, avoiding dripping on the bottle.

The most widespread pourers generally have a hollow cylindrical member intended to be inserted—concealed—inside the neck of the bottle, from which a metering spout exits outward.

In this manner, the outflow section for the liquid is reduced, allowing a more precise metering of the liquid, e.g. into a cup, avoiding that there is an excessive pouring of liquid or that the same can drip on the outer wall of the bottle.

Pourers are also known that are provided with a retractable spout, i.e. configured for exiting outward from the bottle at the time of opening of the cap, generally due to the thrust of a spring housed inside the hollow member, before being reinserted inside the hollow member when not in use.

An example of a similar retractable spout pourer is described in WO0151406, which illustrates a pourer for liquids applicable to a bottle in which the pourer is formed by a sleeve adapted to be stably inserted in the neck of the bottle and at whose interior a cylindrical spout is slidably housed.

These solutions—while allowing the resolution of several drawbacks of the fixed spout solutions, due in particular to the fact that the latter, when not used, must be previously removed from the bottle in order to allow the closure thereof by means of the cap—do not however lack drawbacks.

First of all, the typical shape of these spouts does not allow immediately understanding the correct direction in which to orient the bottle in order to allow the correct pouring of the liquid.

Therefore, it frequently happens that the bottle user pours the liquid from the wrong side, causing the fall of the same or its dripping on the wall of the bottle.

Such incorrect use is even more to be avoided when the pourer is provided with an air vent channel. Indeed, in this case, the erred orientation of the bottle can cause the blocking of the channel, preventing the outflow of the liquid.

Not least, these known retractable pourers are not easily removable from the bottle, such that when the liquid terminates, one is often obliged to throw away both the bottle and the pourer, or to break the pourer itself, which will therefore no longer be usable.

In some pourers, the preferential pouring direction of the liquid is selected in a manner such that when the liquid is poured, the bottle has its label turned towards the person across from the one pouring the liquid, e.g. towards the customer of a bar.

In order to obtain such effect, the application of the label is executed after that of the meter, or vice versa, without particular controlling of the respective positions. Such operative mode therefore is not very efficient and is highly susceptible to errors.

PRESENTATION OF THE INVENTION

The object of the present invention is to overcome the abovementioned drawbacks by attaining a retractable pouring device for bottles which is highly efficient and relatively inexpensive.

One particular object is to make a retractable pouring device that allows the correct orientation of the bottle to which it is applied during the liquid pouring step.

One particular object is to make a retractable pouring device that prevents the incorrect use of the bottle to which it is applied, avoiding that a possible air vent channel can be obstructed that would block the pouring of the liquid.

Another object of the present invention is to make a retractable pouring device that is easy to use and intuitive.

A further object of the present invention is to make a retractable pouring device for bottles that, once removed from the bottle, can be at least in part reused.

A further object of the invention is to make an orienting apparatus for capping plants that allows the quick assembly of the pouring device with a bottle in a perfectly oriented manner with respect to the label of the latter.

Such objects, as well as others which will be clearer below, are achieved by a retractable pouring device in accordance with claim 1.

Due to this particular combination of characteristics, the user of the bottle provided with the pouring device will readily know the direction to orient the bottle in order to pour the liquid in the correct manner, avoiding dripping or lack of liquid outflow if a vent channel is present which could otherwise be obstructed by the liquid itself.

According to a further aspect of the invention, an orienting apparatus is provided for capping plants in which a bottle is assembled with a pouring device according to the invention, achieved in accordance with claim 9.

Due to the particular configuration of the apparatus, it will always be possible to orient the pouring device, and in particular the spout, with respect to the label of the bottle with a constant preferential angle.

For example, it will be possible to orient the spout with respect to the label in a manner such that the inclination of the spout obliges grasping the bottle at a portion without label, in a manner so as to always leave the latter visible to the person across from the user.

Advantageous embodiments of the invention are obtained in accordance with the dependent claims.

BRIEF DESCRIPTION OF THE DRAWINGS

Further characteristics and advantages of the invention will be clearer in light of the detailed description of several preferred but not exclusive embodiments of a pouring device according to the invention and a capping plant comprising an apparatus according to the invention, illustrated as a non-limiting example with the aid of the enclosed drawing tables in which.

DETAILED DESCRIPTION OF SEVERAL PREFERRED EMBODIMENTS

With reference to the mentioned figures, the pouring device according to the invention, indicated in its entirety with the number 1, can be applied to any one bottle B adapted to contain or containing any liquid.

In particular, the pouring device 1 will be adapted to pour any one alimentary liquid, also of alcoholic type. Therefore, the materials used can be of any type, metal or polymer, so long as they are of suitable food grade.

The selection of the material composing the bottle that is intended to be coupled to the device 1 is not at all limiting of the present invention, since the device 1 can be coupled to bottles made of glass, plastic or metal sheet.

It is also understood that the bottle B can be substituted by any other suitable container of liquids.

According to the invention, the device 1 will comprise a tubular body 2 adapted to be anchored, by means of suitable anchorage means, to the neck N of a bottle B.

The tubular body 2 is extended along a predetermined first longitudinal axis X and has an axial cavity 3 therein that is open at the ends for the passage and pouring of the liquid contained in the bottle B.

Figure 1:
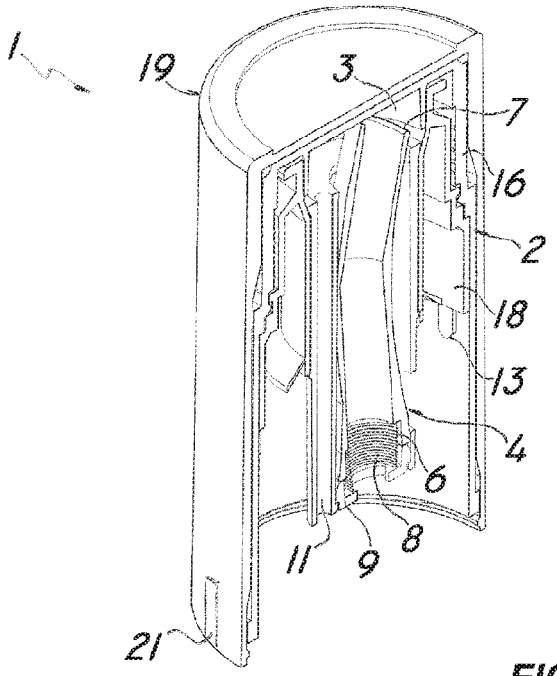
FIG. 1 is a perspective section view of a pouring device according to the invention with a spout in rest position.
Figure 2:
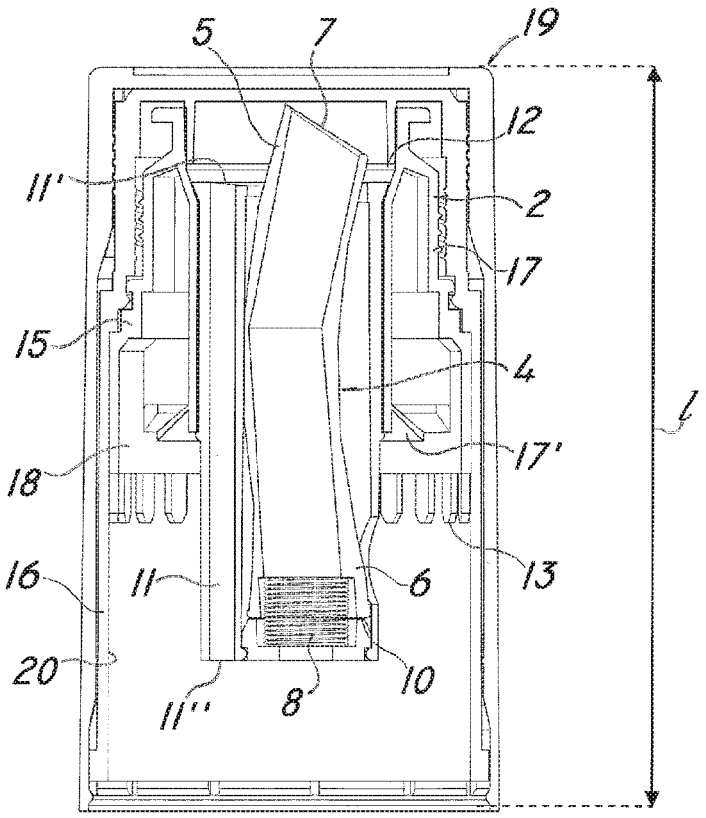
FIG. 2 is a front view in section of the pouring device of FIG. 1.
Figure 3:
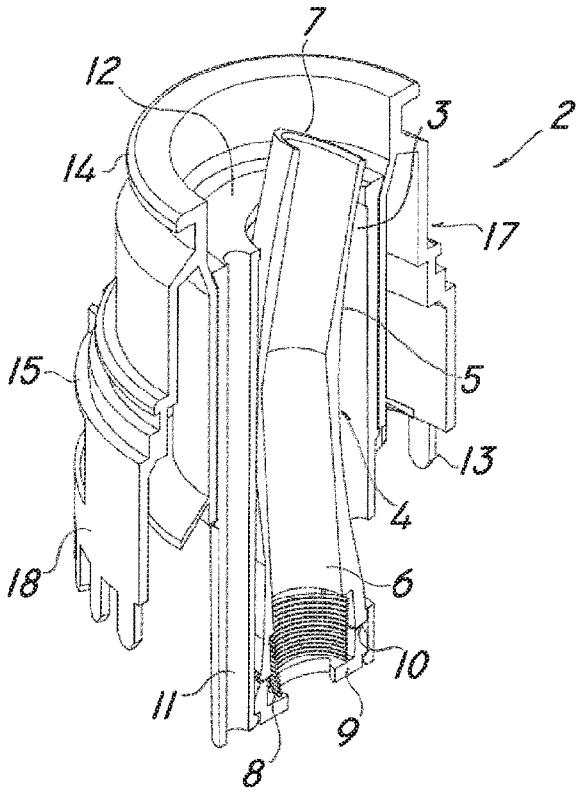
FIG. 3 is a perspective view in section of the pouring device of FIG. 1 lacking any details.
Figure 4:
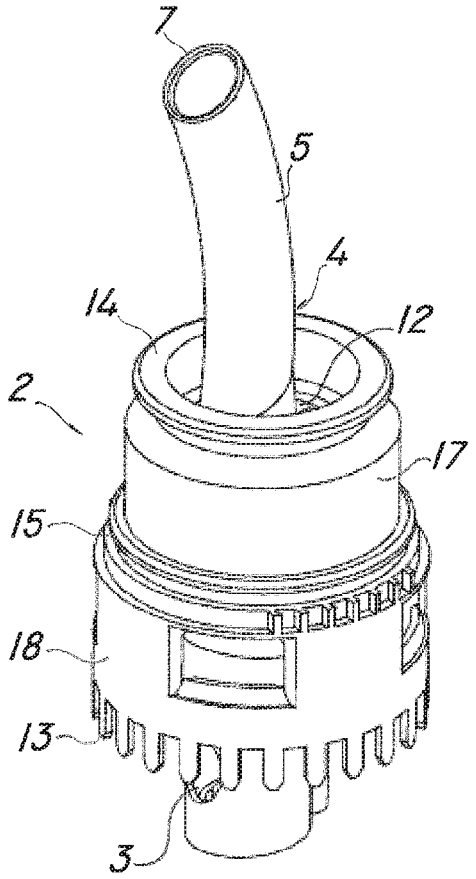
FIG. 4 is a perspective view of a pouring device according to the invention with the spout in extracted work position.
Figure 5:
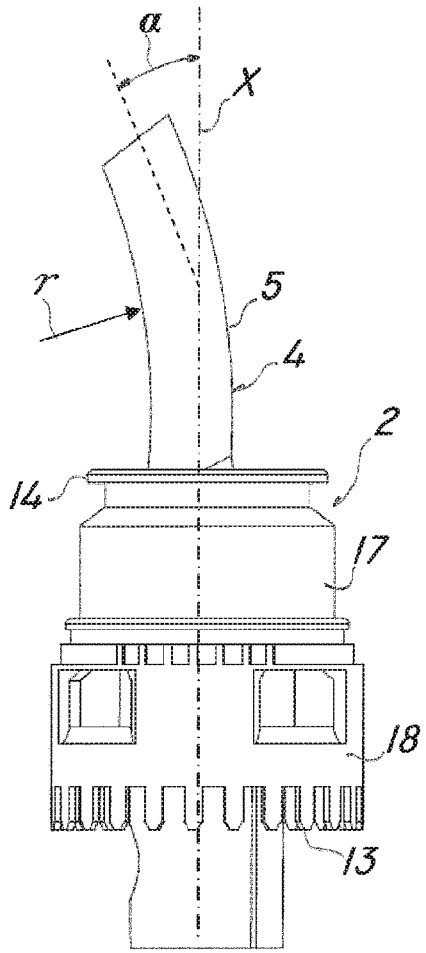
FIG. 5 is a front view of the device of FIG. 4.

Inside the cavity 3, a substantially elongated pouring spout 4 is housed, slidable in the axial cavity 3 in order to be moved between a retracted inoperative position, illustrated in FIGS. 1-3, in which it is completely contained in the cavity 3, and an operative position, illustrated in FIGS. 4 and 5, in which the spout 4 has at least one longitudinal end portion 5 projecting outwardly of the cavity 3 for allowing the controlled pouring of the liquid.

Also for the spout 4, the selection of the materials is not at all a limiting aspect of the present invention, since either metal or polymer materials can be used, possible with metal plating, or any other material, preferably of food grade.

As is more clearly observed from FIG. 5, the projecting longitudinal end portion 5, in operative position, is advantageously inclined by a predetermined inclination angle $\alpha$ with respect to the first longitudinal axis X defined by the tubular body 2 in order to define a selective and preferential orientation for the spout 4 during the pouring of the liquid.

The value of the inclination angle $\alpha$ of the spout 4 can be selected from a wide range of values, and for example will be comprised between 5° and 45° and preferably close to 10°. Nevertheless, other values will be possible without departing from the protective scope of the present invention.

According to a particularly advantageous configuration, the spout 4 will be substantially curved with predetermined curvature radius r selected as a function of the inclination angle $\alpha$ that one wishes to confer to the projecting end section 5 in extracted work position.

The spout 4 will also have substantially cylindrical tubular form with an inlet mouth 6 of the liquid contained in the bottle B and a pouring mouth 7 of the same. Preferably, but not exclusively, the spout 4 will have substantially constant circular or elliptical section along its longitudinal extension. The axial cavity 3 will be substantially cylindrical with cross section with maximum dimension a greater than the maximum diameter d of the cross section of the spout 4.

In this manner, the spout 4 can carry out a minimum rotation around a transverse axis during its sliding between the operative position and the inoperative position.

For example, the cavity 3 will have elliptical section with greater axis a with higher value than the diameter d of the circular section of the spout 4.

In a known manner, inside the cavity 3, opposing elastic means 8 will be housed that are adapted to operate with the spout 4 at its inlet mouth 6, in order to force it to pass from the inoperative position to the operative position and maintain it in such latter position.

The elastic means 8 can be configured according to any one of the known modes for retractable pouring devices. In a merely exemplifying manner, the elastic means 8 can be constituted by a helical spring housed in the cavity 3 and having a lower section in abutment against the partially open bottom wall 9 of the tubular body 2 and an upper section in abutment against the lower edge 10 of the spout 4.

Inside the tubular body 2, a vent channel 11 can also be provided that will be extended in substantially axial direction, flanking the axial cavity 3. The vent channel 11 will be open at the ends 11', 11" in order to allow the passage of air inside the bottle B.

Figure 6:
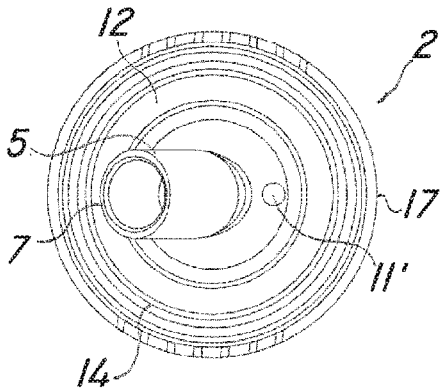
FIG. 6 is a top view of the device of FIG. 4.

Advantageously, the external opening 11' of the vent channel 11 will be made in the upper wall 12 of the tubular body 2 on the side where the spout 4 directs its convexity, as is more clearly visible in FIG. 6.

In a first embodiment, the tubular body 2 will be of the type that is entirely insertable via pressing inside the neck N of the bottle B.

In a particular variant, corresponding to FIG. 4, the tubular body 2 will comprise an annular end portion 13 configured for being stably inserted via pressing in the neck N of the bottle B, and an upper portion 14 provided with a lateral surface 15 threaded for coupling by means of screwing of a closure cap of the bottle B.

According to a particularly advantageous alternative configuration, corresponding with FIGS. 1 and 2, the tubular body 2 will comprise a lower cylindrical rim 18 intended to be applied, at its lower portion 13, on the neck N of the bottle B, e.g. by means of pressure.

In addition, the tubular body 2 will comprise a cylindrical bush 17 that is provided at its interior with a second tubular body having the axial cavity 3 therein and the possible vent channel 11. In addition, the bush 17 may comprise the lower cylindrical rim 18, adapted to be stably applied over the neck N of the bottle B, e.g. by means of pressure capping.

The bush 17 may be provided with the upper end portion 14 configured for projecting with respect to the neck N of the bottle and having a lateral surface 15 that is externally threaded for the screwing of a tubular sleeve 16 that is stably coupled internally of a cylindrical cap 19.

Figure 12:
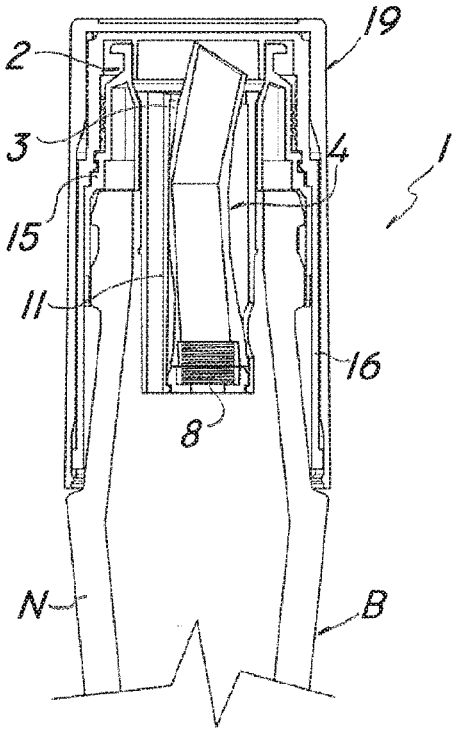
FIG. 12 is a front sectional view of the pouring device of FIG. 1 mounted on a bottle.

In practice, upon completed assembly, the neck N of the bottle B will be inserted inside the cylindrical rim 18 of the bush 17 as shown in FIG. 12.

In a non-illustrated variant, the cylindrical rim 18 has a lower end portion 13 provided with an internal thread for anchoring by means of screwing to the bottle neck N, which will in turn be provided, in a typical manner, with an at least partially counter-threaded external surface.

Due to these particular characteristics, the pouring device 1 can be easily removed from the bottle B, preserving the integrity of one or more of its parts, in a manner so as to be able to reuse the bottle B and/or the device 1.

The bush 17 can also comprise a seal ring 17' coaxial with the cavity 3 in order to ensure the hermetic seal of the device 1 coupled to the bottle B.

The cap 19 with which the device 1 and hence the bottle B will be closed can be that of the bottle B itself, but advantageously it can be specially designed.

In particular, the cylindrical cap 19 internally has stably coupled, in its interior, the tubular sleeve 16 that is internally threaded at a portion of its internal lateral surface 20, in order to be screwed to the upper portion 15 of the tubular body 2.

Advantageously, the cap 19 will have length l substantially equal to that of the tubular body 2 so as to enclose it in a substantially complete manner and to obtain a particularly pleasant aesthetic effect.

In addition, the cylindrical cap 19 will have a reference member 21 on its external lateral surface 22 which will allow its angular orientation during the step of assembly with the bottle B. The reference member 21 will in fact unequivocally define the inclination direction of the spout 4 in extracted position, i.e. the position plane of its curvature, always allowing the application of the device 1 to the neck N of the bottle B in correct position.

The reference member 21 can be a mark made on the external surface 22 of the cap 19 or a reference cut, a projection, a notch or the like.

During use, upon removal of the cap 19, the spout 4 will be freed; the latter, under the pressure of the elastic means 8, will pass from the retracted position to the extracted position, with its longitudinal end portion 5 always at the correct angle.

In order to return the spout 4, it will instead suffice to rescrew the cap 19, which will press on the spout 4 by operating against the elastic means 8 in order to bring it back to the retracted condition.

Figure 7:
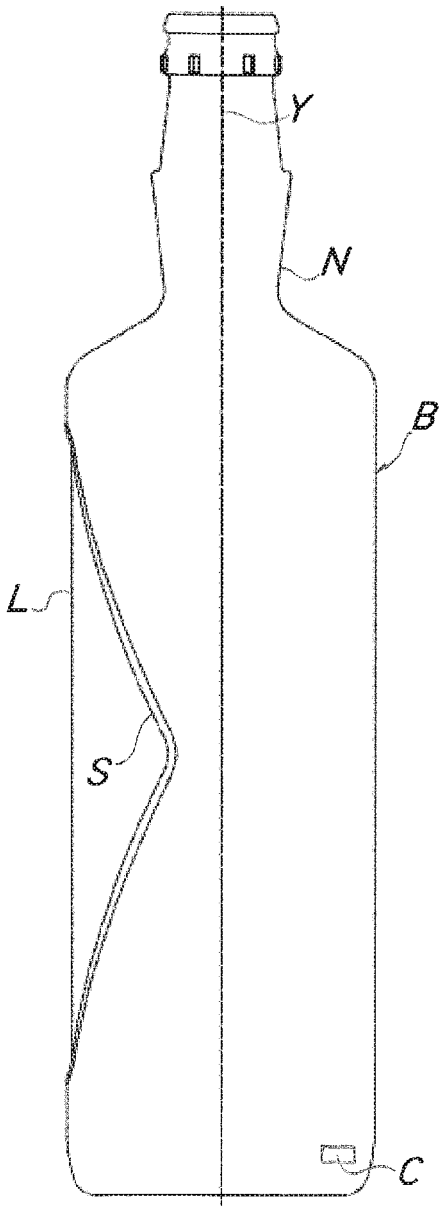
FIG. 7 is a side view of a bottle that can be coupled to a pouring device according to the invention.

In FIG. 7, a bottle B is illustrated that can be coupled to the pouring device 1 according to the invention. The bottle B has a lateral wall W defining a second longitudinal axis Y and having a pouring neck N and a portion to be labeled L.

Such portion L can be constituted both by a non-shaped part of the lateral wall W of the bottle B and by a portion of the same provided with a seat S suitably shaped for receiving a label. In this manner, the orientation of the device 1 with respect to the bottle B can be obtained even without a label, since the reference will be defined by the label seat S.

Advantageously, the bottle B can have a notch C made in its lateral wall, preferably in proximity to the bottom wall, or in the bottom wall itself.

Nevertheless, the device 1 can be coupled to any one bottle, even of the type that was not specially arranged.

Figure 8:
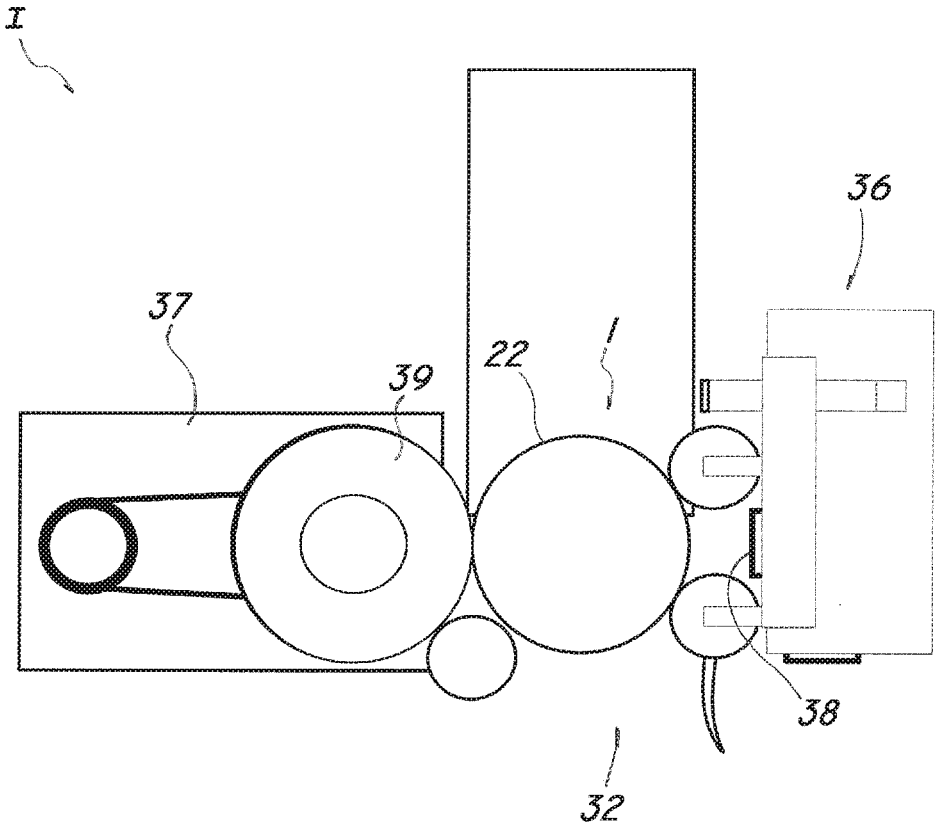
FIG. 8 is a schematized view of several details of a capping plant comprising an orienting apparatus according to the invention.
Figure 9:
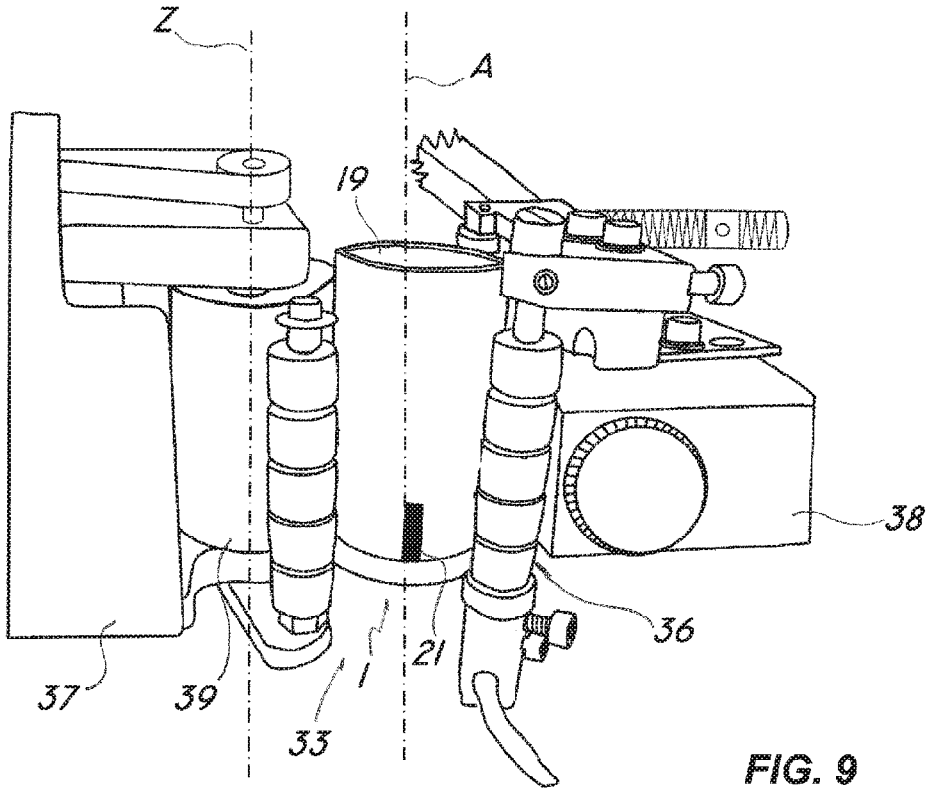
FIG. 9 is a front view of a first detail of an apparatus according to the invention.

Illustrated in FIG. 8, in a schematic manner, is one part of a capping plant I in which the assembly is executed of a device 1 according to the invention with a bottle B; such plant is provided with a capping apparatus according to the invention, generically indicated with 31.

As will nevertheless be clearer below, the plant I thus configured can be used for the oriented assembly of a bottle with any one pouring device, not necessarily of the type according to the invention.

In a known manner, the capping line will comprise a work station with a capping head having at least one assembly position 32 with a first seat 33 for the positioning of at least one pouring device 1 at a time and a second seat 34 for the positioning of at least one bottle B at a time.

The first seat 33 will be superimposed on the second 34 and aligned therewith along a predetermined coupling axis A, which will preferably be parallel to or coinciding with the longitudinal extension axes X, Y defined above.

In addition, the assembly position 32 will be configured for retaining both the device 1 and the bottle B in a manner so as to leave them free to rotate around the respective longitudinal axes X, Y.

Also provided for are feeding means, substantially of known type, for at least one pouring device 1 at a time and at least one bottle B at a time, respectively into the first 33 and into the second seat 34.

Figure 10:
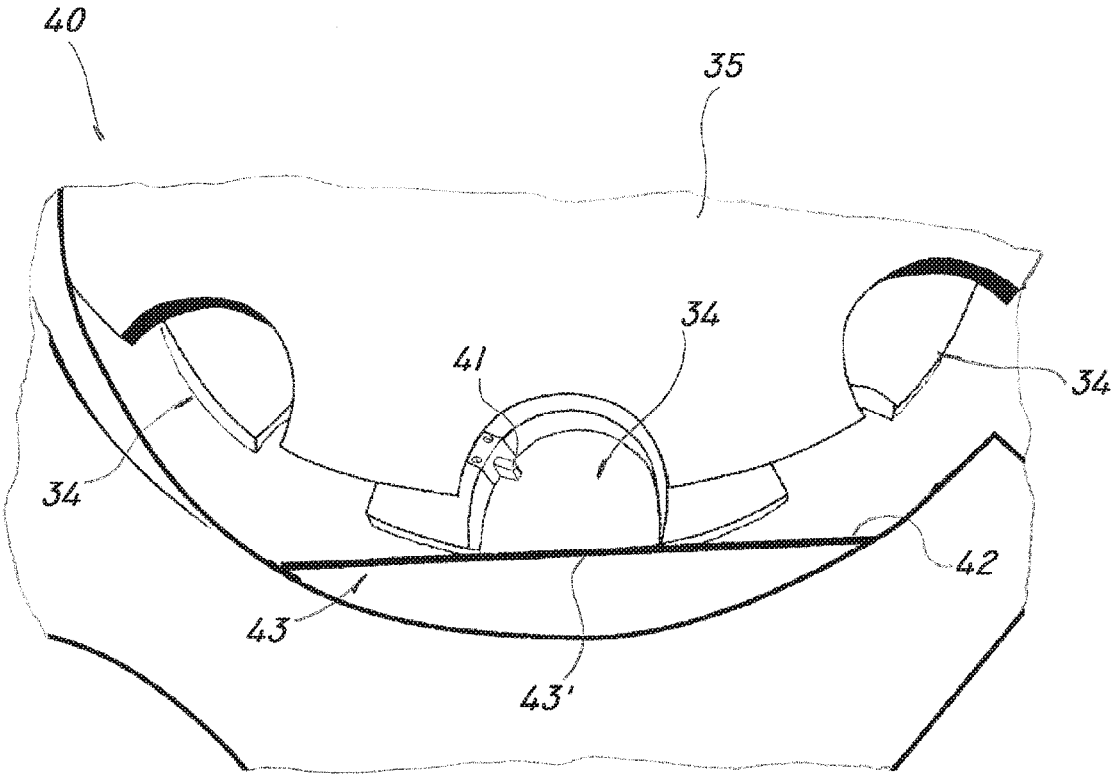
FIG. 10 is a top view of a second detail of an apparatus according to the invention.

Such feeding means can be configured according to one of the modes known to the man skilled in the art. For example, they can comprise a star conveyor 35, illustrated in FIG. 10, provided with a plurality of second seats 34 for respective bottles B. The conveyor 35 will be rotatable around a vertical axis in order bring one second seat 34 at a time into the assembly position 32.

Also provided for are means for coupling the device 1 present in the first seat 33 with the neck N of the bottle B present in the second seat 34.

Also the coupling means can be selected from among those commonly employed for such assembly lines, and for this reason are not illustrated in detail. For example, in a known manner, they can comprise a capping machine for their stable coupling, which can occur via pressing or screwing.

In each case, the coupling means will be configured for moving the pouring device 1 with regard to the bottle B at least along the coupling axis A.

The apparatus 31 will be advantageously positioned at the work station and still more preferably at the capping head.

Suitably, the apparatus 31 will comprise orientation means 36 of the pouring device 1 with respect to the portion to be labeled L of the bottle B, in a manner so as to always arrange the spout 4 of the device 1 in a predetermined angular position with respect to such portion to be labeled L.

In particular, the orientation means 36 will comprise a first actuator 37 placed adjacent to the first seat 33 in order to interact with the pouring device 1 housed in the same and to bring it in rotation around its longitudinal axis X with a controlled rotation angle.

In addition, the orientation means 36 will comprise a position sensor 38 configured for interacting with the reference member 21 and disabling the first actuator 37 following the interaction with the mark 21.

In this manner, it will be possible to control the rotation angle, blocking the device 1 in a manner such that the reference member 21, which unequivocally indicates the oriented position of the spout 4, comes to be situated in a predetermined fixed angular position for all the devices 1, allowing identical orientation of the spout 4 with respect to the portion to be labeled L for all the bottles B.

Naturally, it will always be possible to modify the position at which the rotation of the device 1 will have to be stopped, so that it can be oriented even with any angle with respect to the portion to be labeled L of the bottle B.

According to a preferred but not exclusive configuration of the invention, the orientation means 36 will comprise an electronic control unit, not shown, for example an electronic circuit with microprocessor, which connects the first actuator 37 with the sensor 38.

The latter will be configured for sending a detection signal of the reference member 21 present on the device 1 to the control unit, which will consequently send a stop commend to the first actuator 37.

The sensor 38 can be selected from among those commonly available on the market and can be, for example, in a non-limiting manner, a proximity sensor, an optical detector or a probe, e.g. of touching type. The selection of the sensor type will naturally be bound to the characteristics of the reference member 21.

For example, in the case in which the reference member 21 is defined by a line designed on the device 1, for example on the cap 19, having color or light reflection index different from the background surface, the position or proximity sensor 38 can comprise a proximity photocell.

The first actuator 37 can comprise a substantially cylindrical roller 39 that is motorized, for example, by means of a stepping motor.

In this case, the control unit can be programmed for stopping the motor after a preset number of steps starting from the reception of the signal by the sensor 38.

The roller 39 will be rotatably mounted around an axis Z parallel to the coupling axis A of the device 1 and will be flanking the first seat 33 in order to interact with the lateral surface of the pouring device 1 present in the same, in a manner so as to bring it into rotation via friction.

The orientation means 36 will also comprise a second actuator 40 adjacent to the assembly position 32, in particular to the second seat 34, which will be configured to interact with the bottle B placed in the same, in order bring it into rotation via friction around the second longitudinal axis Y.

In particular, the second actuator 40 will comprise a friction surface 42 at least partially peripherally arranged with respect to the seat 34 of the bottle in order to come into contact with the lateral wall W of the same, in a manner so as to bring it into rotation via friction.

For example, the second actuator 40 can comprise a friction member 43, e.g. an annular belt having a section 43' intended to come into contact, by means of its friction surface 42, with the lateral wall W of the bottle B in order to bring it into rotation.

The friction member 43 can be of the type that is adjustable along a transverse direction, so that the interference and thus the friction with the bottle B can be increased or decreased.

Figure 11:
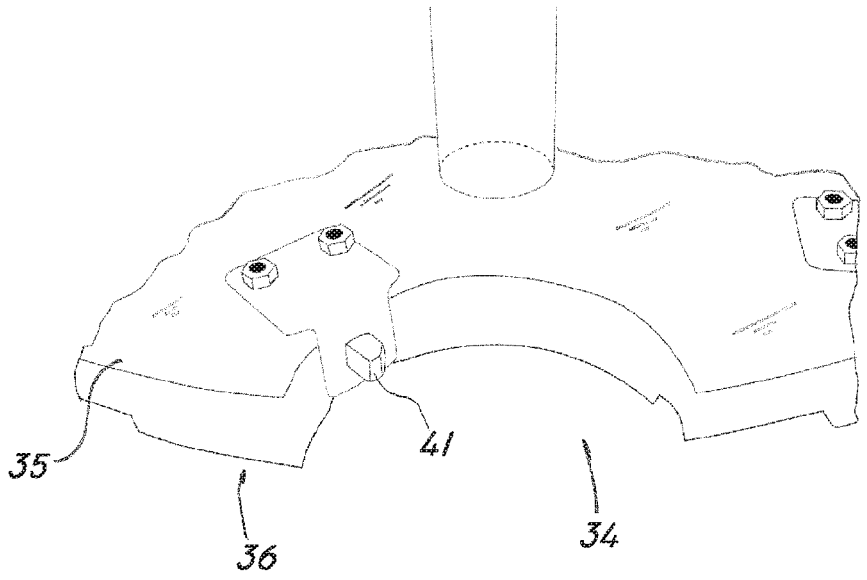
FIG. 11 is a perspective view of a detail of FIG. 10.

Suitably, the orientation means 36 can comprise a hooking elastic member 41, visible in FIG. 11, configured to elastically interact with the notch of the bottle in order to block the rotation thereof.

For example, the star conveyor 35 defined above can have, for each of its second seats 34, a hooking elastic member 41 transversely projecting along a substantially horizontal radial direction.

In this manner, following the rotation of the bottle set by the second actuator 40, the lateral wall W of the bottle B will compress the hooking member until it encounters the notch C and is snap-inserted therein, in such a manner coupling the bottle B and blocking it in an oriented position.

Operatively, the device 1 will be fed in the assembly position 32 in order to reach the first seat 33 in a non-oriented position. At the same time, a bottle B will also be fed inside the second seat 34.

Preferably, the device 1 will already be provided with the cap 19 with the reference member 21 situated thereon.

At the assembly position 32, a common capping head can be arranged, not shown, selected from among those normally employed in the field; such head will subsequently couple the pouring device 1 to the neck N of the bottle B.

At this point, the sensor 38, e.g. the photocell, will send a start signal to the control unit, which will drive the motorization of the first actuator 36 so as to bring the roller 39 into rotation.

The roller 39 will drive the device 1 in rotation around its axis X until the sensor 38 intercepts the reference member 21. Once such member 21 is detected, the sensor 38 will send a stop signal to the control unit, which will block first actuator 37 immediately or after a preset number of motor revolutions, and the roller 39 will also be blocked, so as to stop the device 1 in the oriented position.

The electronic unit can also be provided with means for adjusting one or more operative parameters of the line, such as the stop position, motor speed and acceleration/deceleration ramps, start timing and the like.

An alarm could also be arranged which detects when the reference member 21 is not readable or is absent, generating an error signal and consequent block or discarding of the piece being processed.

At the same time, one will proceed with the feeding in assembly position 32 of the bottle B and with the orientation thereof. For example, the star conveyor 35 will rotate in order to bring one bottle B at a time into the assembly position 32.

In this rotation, the bottle B will intercept the possibly motorized friction member 40, starting rotation around its longitudinal axis Y until its notch C is engaged by the hooking member 41 which will stop its rotation around the axis Y, blocking in a predetermined angular position.

Once the device 1 and the bottle B are oriented in the correct position, one will proceed with their coupling according to any one of the known techniques, e.g. by means of screwing or pressure locking.

From that stated above, it is clear that the pouring device and the orienting apparatus according to the invention attain the pre-established objects, and in particular that of always indicating the pouring direction of the liquid, as well as that of allowing a quick assembly of the device with the bottle.

Indeed, the plant provided with such apparatus will allow coupling the device to the bottle in extremely limited times, on the order of a few milliseconds, maintaining however a very high coupling precision.

The device and the apparatus according to the invention are susceptible to numerous modifications and variations, all falling within the inventive concept expressed in the enclosed claims. All details can be substituted with technically equivalent elements, and the materials can be different according to requirements, without departing from the scope of the invention.

Even if the device and the apparatus were described with particular reference to the enclosed figures, the reference numbers used in the description and in the claims are used for improving the comprehension of the invention and do not constitute any limitation of the claimed protective scope.

The invention claimed is:

1. A liquid pouring device for bottles or the like, comprising:

a tubular body having a longitudinal axis and a substantially cylindrical bush and a second tubular body fixedly disposed within said bush, said second tubular body having a portion to penetrate within a neck of a bottle coupled to the pouring device and being provided with an axial cavity having ends open for passage and pouring of a liquid contained in said bottle;

means for anchoring said tubular body to said neck of said bottle;

a substantially elongated pouring spout slidably inserted into said axial cavity for moving between an inoperative position completely inside said cavity and an operative position wherein said spout has at least one longitudinal end portion projecting outwardly of said cavity for allowing a controlled pouring of the liquid;

wherein said longitudinal end portion, in said operative position, is inclined with a predetermined inclination angle with respect to said longitudinal axis defining a selective orientation for said spout during the pouring of the liquid;

wherein said substantially cylindrical bush has a first longitudinal end portion configured to project with respect to the neck of the bottle, and a lateral surface externally threaded for screwing of a cap, and a second opposite end portion at least partially insertable in the neck of the bottle; and wherein said axial cavity has a elliptical cross section with a major diameter greater than a maximum diameter of said spout in order to allow a partial rotation of said spout around a transverse axis during sliding between said inoperative position and said operative position.

2. The device according to claim 1, wherein said spout is substantially cylindrical with a substantially constant cross section and is curved with a predetermined curvature radius.

3. The device according to claim 1, wherein said tubular body has an annular end portion provided with an internal thread for anchoring by screwing to a counter-threaded bottle neck.

4. The device according to claim 1, wherein said tubular body comprises a cylindrical rim anchorable to the neck of said bottle.

5. The device according to claim 4, wherein said second end portion of said bush is stably inserted in said sleeve.

6. The device according to claim 4, wherein said cap comprises a tubular sleeve stably coupled within said cap, said tubular sleeve being internally threaded for screwing onto said externally threaded lateral surface of said cylindrical bush.

7. The device according to claim 5, further comprising a cylindrical cap screwable on said first end portion of said bush and having a length substantially equal to a length of said tubular body for enclosing said tubular body in a substantially complete manner.

8. The device according to claim 7, wherein said cylindrical cap has a reference member on an external lateral surface for angular orientation with respect to said spout.

9. The device according to claim 1, further comprising an elastic member that interacts with said spout at an inlet mouth of said spout to force said spout to pass from said inoperative position to said operative position and maintain said spout in said operative position until said cap is screwed on said cylindrical bush to bring said spout back to a retracted position.

* * * * *